US007040725B1

(12) United States Patent
Mao-Chin

(10) Patent No.: US 7,040,725 B1
(45) Date of Patent: May 9, 2006

(54) DEVICE FOR LOCKING RETRACTED DRAWER SLIDE

(76) Inventor: Shon Mao-Chin, No.12, Alley 2, Lane 43, Jhongcing Rd., Taichung (TW)

( * ) Notice: Subject to any disclaimer, the term of this patent is extended or adjusted under 35 U.S.C. 154(b) by 0 days.

(21) Appl. No.: 10/998,326

(22) Filed: Nov. 23, 2004

(30) Foreign Application Priority Data

Dec. 24, 2003 (TW) ..... 92136773 U

(51) Int. Cl.
*A47B 88/04* (2006.01)

(52) U.S. Cl. ..... 312/334.44; 312/333; 312/319.1

(58) Field of Classification Search ..... 312/330.1, 312/333, 334.1, 334.6, 334.7, 334.8, 334.11, 312/334.12, 334.27, 334.33, 334.44, 334.46, 312/334.47, 319.1
See application file for complete search history.

(56) References Cited

U.S. PATENT DOCUMENTS 5,302,016 A * 4/1994 Lautenschlager et al. ... 312/333
5,580,138 A * 12/1996 Grabher ..... 312/319.1
6,340,078 B1 * 1/2002 Scheible ..... 188/166
6,375,290 B1 * 4/2002 Lin et al. ..... 312/334.46
6,629,738 B1 * 10/2003 Salice ..... 312/333
6,733,097 B1 * 5/2004 Kim et al. ..... 312/333
6,736,471 B1 * 5/2004 Lin ..... 312/333
2002/0033658 A1 * 3/2002 Salice ..... 312/334.14

FOREIGN PATENT DOCUMENTS

DE 4328502 * 3/1994

* cited by examiner

*Primary Examiner*—James O. Hansen
(74) *Attorney, Agent, or Firm*—W. Wayne Liauh

(57) ABSTRACT

Provided is a locking device at a rear of an outer slide member of a drawer. The device comprises a groove including an intermediate shoulder and a spring loaded sliding member in the groove, the sliding member including a bottom stop surface, a top notch, and a front hook. In a retracting operation pushing an inner slide member will cause a projected lock pin thereof to contact the notch and retain therein; move the stop surface upwardly to disengage from a front end of the groove due to an upward pivot of the sliding member with respect to the lock pin; cause the inner slide member to continue its rearward pushing along the groove due to a compression of the spring; and end the retraction after the sliding member is stopped by the shoulder. The device can lock a retracted drawer slide.

4 Claims, 14 Drawing Sheets

DEVICE FOR LOCKING RETRACTED DRAWER SLIDE

FIELD OF THE INVENTION

The present application claims foreign priority based on a TAIWAN Patent Application Filed on Dec. 24, 2003, Application No. 092136773.

The present invention relates to drawer slide locking hardware and more particularly to a device mounted in either inner slide member for locking the inner slide member after fully retracting a drawer.

BACKGROUND OF THE INVENTION

A conventional drawer slide assembly 10 is shown in FIGS. 1 and 2 and comprises an inner slide member 11 affixed to the wall of drawer (not shown), an outer slide member 13 affixed to the wall of cabinet (not shown), and a ball bearing retainer 12 provided between the inner slide member 11 and the outer slide member 13. The ball bearing retainer 12 comprises two rows of ball bearings 121 in which each row rolls against opposite grooves along either one of two lengthwise edge portions of the inner slide member 11 and the outer slide member 13. The provision of ball bearings 121 can reduce friction when the inner slide member 11 slides with respect to the outer slide member 13, i.e., facilitating retracting or extending operation of the drawer. However, the prior art suffered from several disadvantages. For example, the drawer tends to slide out of the cabinet when the cabinet is disposed in an inclined supporting surface. This is because there is no provision of a device in the slid assembly 10 for locking the retracted drawer.

Another conventional drawer slide assembly 20 for overcoming the above problem is shown in FIG. 3 and comprises an elongated groove-shaped outer slide member 21, and an inner slide member 22 slidably received in the groove of the outer slide member 21 by means of a ball bearing retainer 23 having two rows of ball bearings each rolling either between a top wall of the inner slide member 22 and an upper inner groove of an inner section 211 or between a bottom wall of the inner slide member 22 and a lower inner groove of the inner section 211. A large space 213 is formed between the inner slide member 22 and an outer section 212 so as to mount a device for locking retracted drawer slide 24 in a rear portion of the space 213.

The device for locking retracted drawer slide 24, as illustrated in FIGS. 4 and 5, is affixed to a seat 241 on an inner surface of the inner section 211 by means of a spring 242. The spring 242 has one end secured to the seat 241 and the other end secured to a hook 2431 of a sliding member 243. The sliding member 243 further comprises a pin 2432 slidable along an elongate L-shaped groove 2411 on the seat 241, and a notch 2433 adapted to receive a lock pin 221 on the inner slide member 22. In an extending operation of drawer, the sliding member 243 moves by sliding the inner slide member 22 forwardly in response to receiving the lock pin 221 in the notch 2433. The pin 2432 will change its moving direction after reaching a turning point of the L-shaped groove 2411, i.e., the sliding member 243 turns. Thereafter, the lock pin 221 disengages from the notch 2433 for permitting a further movement of the inner slide member 22. In a retracting operation of the drawer, slide the inner slide member 22 inwardly until the lock pin 221 enters the notch 2433 and is retained therein. And in turn, the sliding member 243 turns to move the pin 2432 to pass the turning point. Once the pin 2432 passes the turning point, the sliding member 243 and thus the inner slide member 22 automatically move inwardly along the groove 2411 due to the compression of the spring 242. The second prior art is able to position the retracted drawer. But this is still unsatisfactory for the purpose for which the invention is concerned for the following reasons: The second prior assembly is relatively complex in constructions, relatively large, costly to manufacture, trouble-prone, and unreliable in use and thus has not found wide acceptance. Thus, the need for improvement still exists.

SUMMARY OF THE INVENTION

It is an object of the present invention to provide a simple, compact, and cost effective device disposed in a rear portion of an outer slide member for locking a retracted drawer slide.

To achieve the above and other objects, the present invention provides a telescoping slide assembly for supporting a movable drawer in a cabinet, the slide assembly comprising an outer slide member affixed to a wall of the cabinet; an inner slide member affixed to the wall of drawer, the inner slide member comprising a lengthwise channel including an outwardly projected lock pin; a ball bearing retainer provided between the outer and inner slide members for facilitating sliding of the inner slide member with respect to the outer slide member; and locking means disposed in a rear portion of the outer slide member, the locking means comprising an elongate plate, a groove provided on an inner surface of the plate, the groove including a shoulder at its intermediate narrow neck portion, a resilient member having one end affixed to a rear end of the groove, and an elongate sliding member having its rear end secured to the other end of the resilient member, the sliding member including a bottom stop surface, a top notch, and a front hook wherein the rear end of the sliding member urges against the shoulder due to a compression of the resilient member and the lock pin is retained by the hook when the inner slide member is in a retracted position, whereby in an initial extending operation of the inner slide member pulling the inner slide member will: pull the sliding member forward along the groove and expand the resilient member; drop a forward portion of the sliding member due to no support thereunder after passing a front end of the groove; cause the lock pin to clear the hook after the stop surface abuts a mouth of the front end of the groove; and cause the inner slide member to continues its forward pulling; in a subsequent retracting operation of the inner slide member pushing the inner slide member will: cause the lock pin to contact the notch and retain therein; move the stop surface upwardly to disengage from the mouth of the front end of the groove due to an upward pivot of the sliding member with respect to the lock pin; cause the inner slide member to continue its rearward pushing along the groove due to a compression of the resilient member; and end the retracting operation after the rear end of the sliding member is stopped by the shoulder; and in a subsequent extending operation of the inner slide member pulling the inner slide member will: pull the sliding member forward along the groove and expand the resilient member; drop a forward portion of the sliding member due to no support thereunder after passing the front end of the groove; cause the lock pin to clear the notch after the stop surface abuts the mouth of the front end of the groove; and cause the inner slide member to continues its forward pulling.

The above and other objects, features and advantages of the present invention will become apparent from the following detailed description taken with the accompanying drawings.

DETAILED DESCRIPTION OF THE PREFERRED EMBODIMENTS

Figure 1:
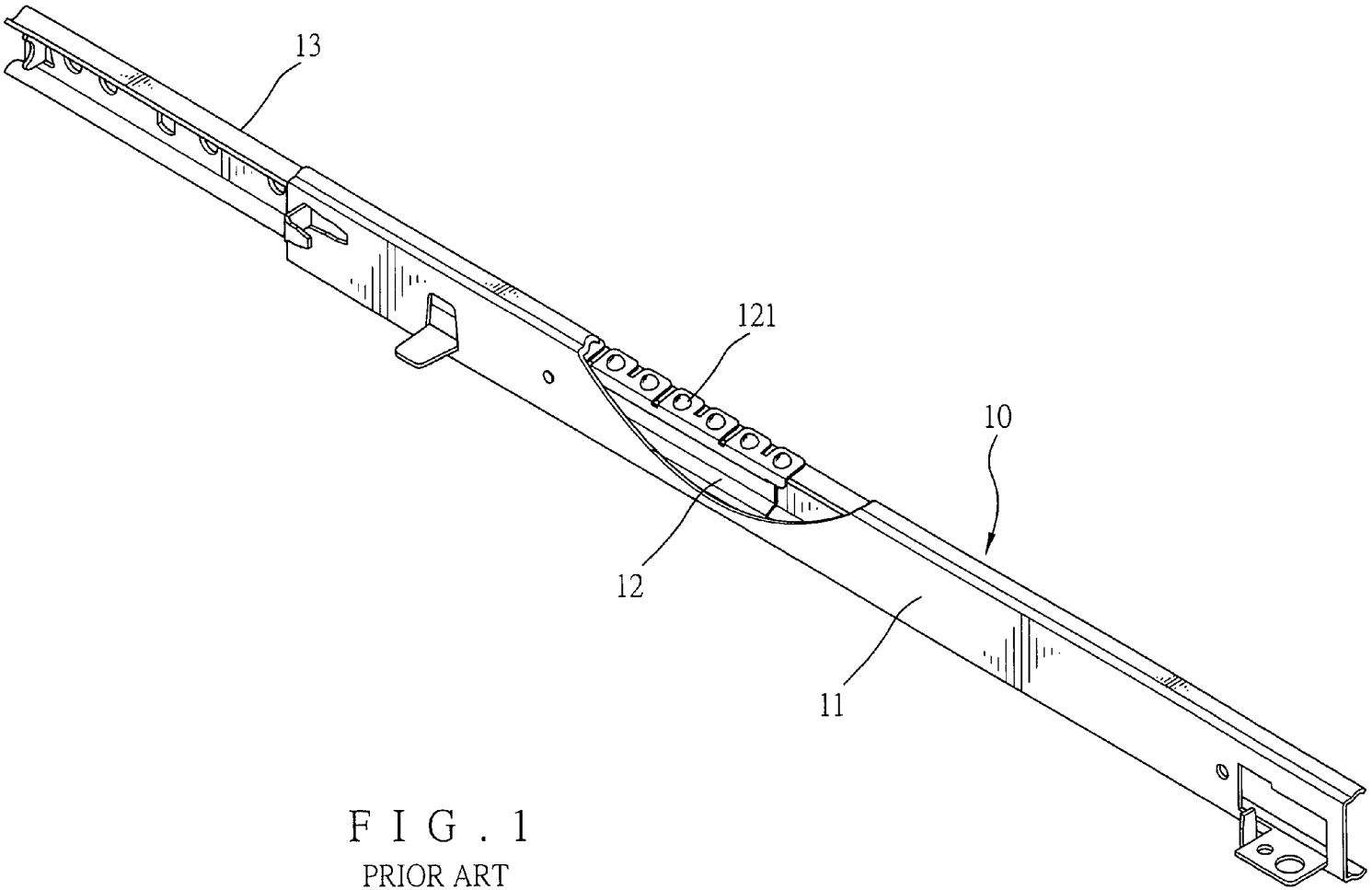
FIG. 1 PRIOR ART
FIG. 1 is a perspective view of a conventional drawer slide assembly with a portion of inner slide member removed for illustrating purpose.
Figure 2:
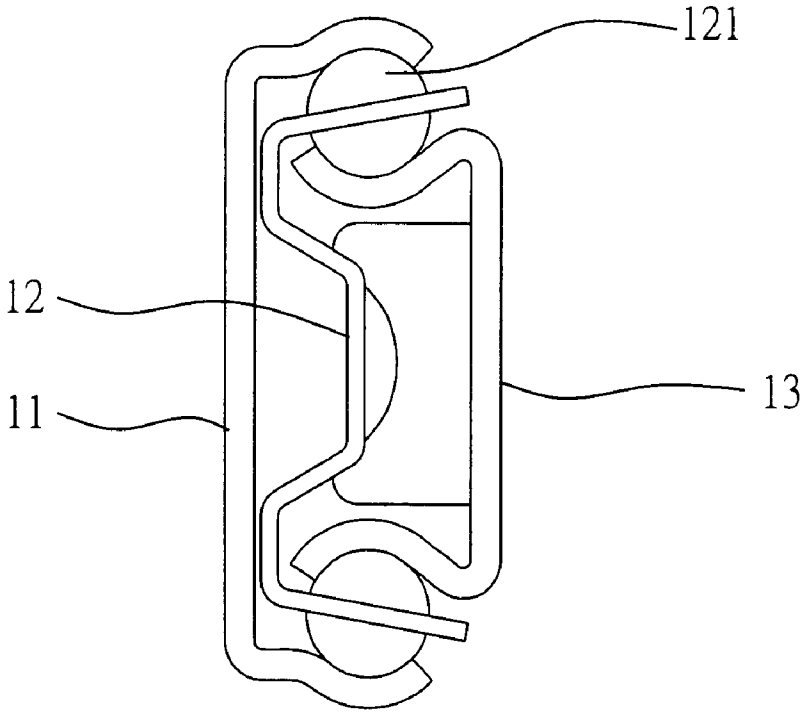
FIG. 2 PRIOR ART
FIG. 2 is a sectional view of the assembly of FIG. 1.
Figure 3:
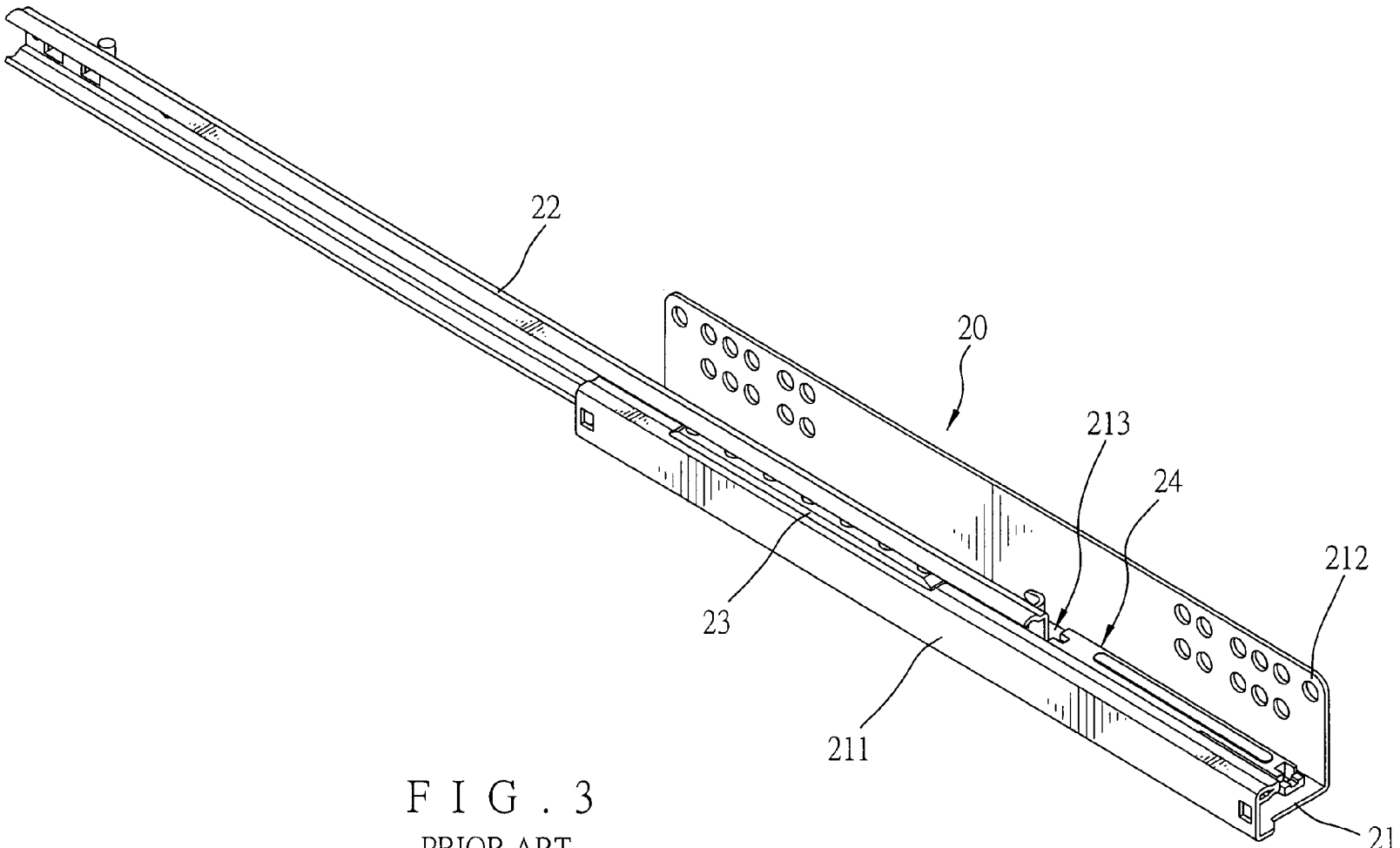
FIG. 3 PRIOR ART
FIG. 3 is a perspective view of a second conventional drawer slide assembly.
Figure 4:
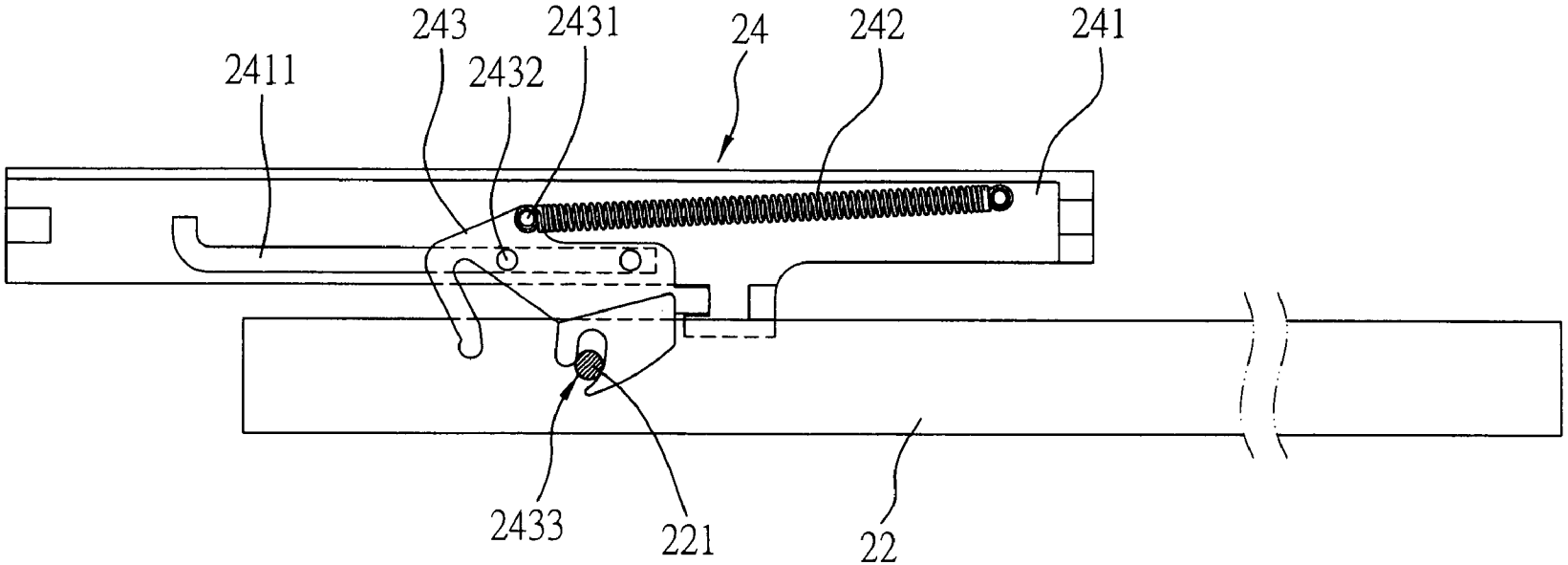
FIG. 4 PRIOR ART
FIG. 4 is a side view schematically depicting a device for locking retracted drawer slide of FIG. 3.
Figure 5:
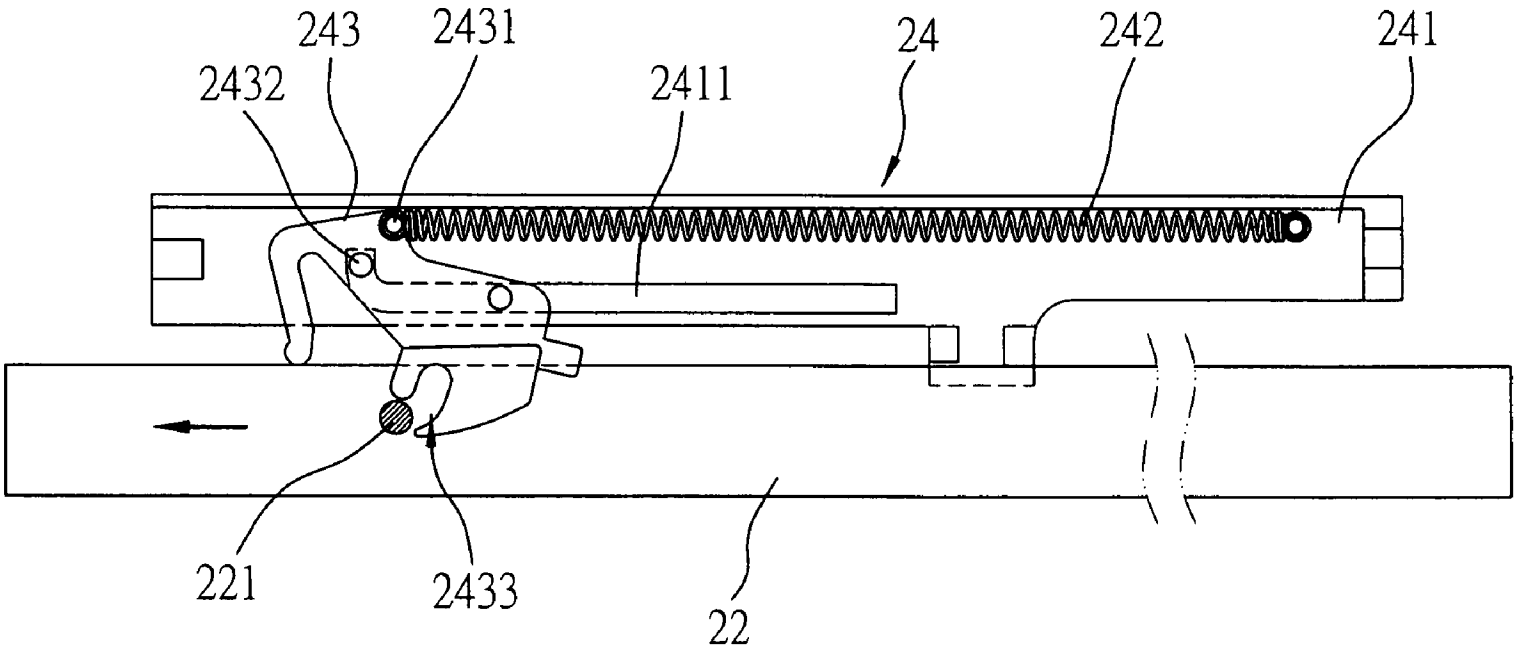
FIG. 5 PRIOR ART
FIG. 5 is a view similar to FIG. 4 where the inner slide member is still extending after disengaging the device for locking retracted drawer slide.
Figure 6:
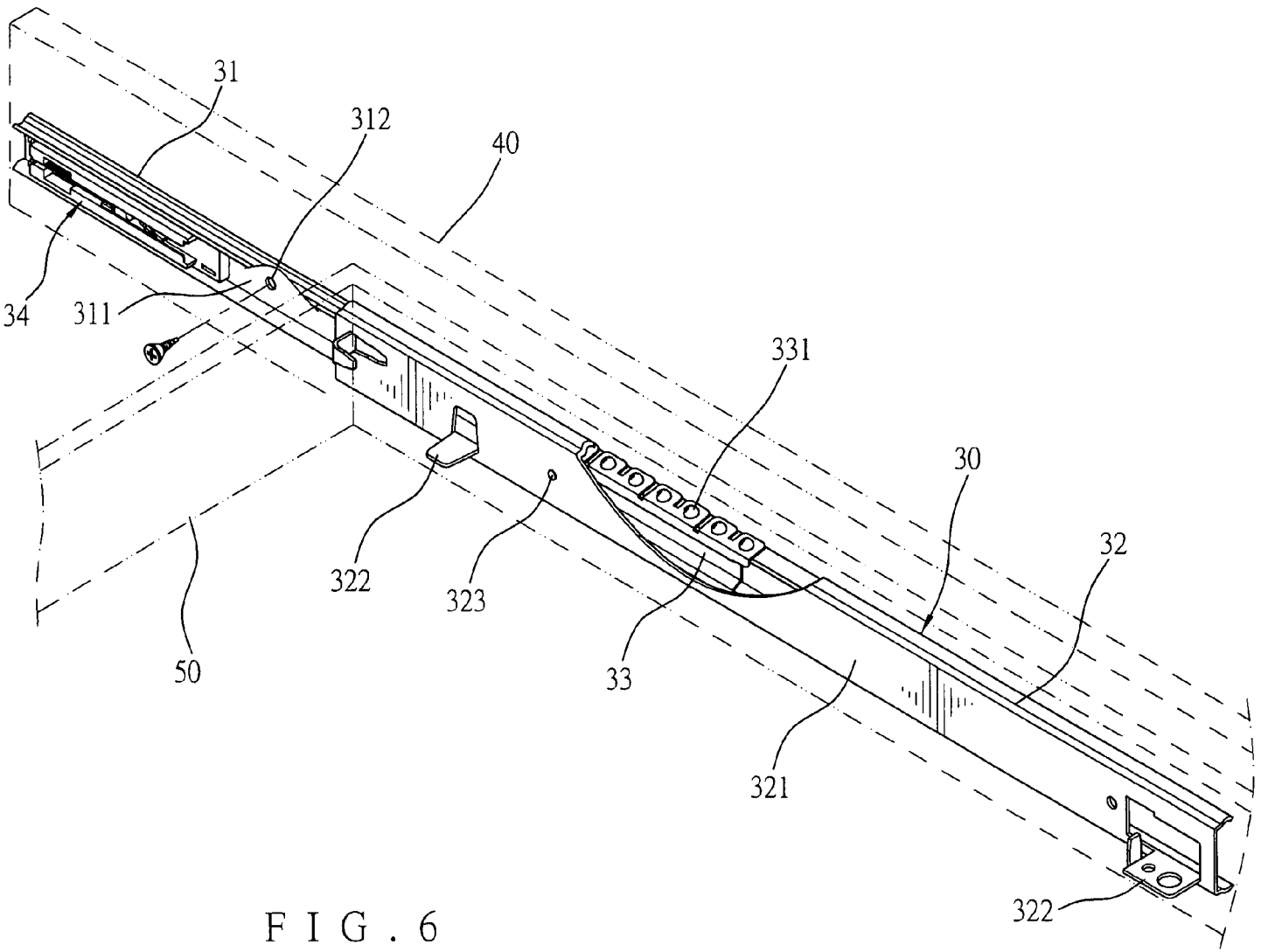
FIG. 6 is a schematic perspective view of a drawer slide assembly incorporating a device for locking retracted drawer slide according to a preferred embodiment of the invention.

Referring to FIG. 6, there is shown a drawer slide assembly 30 incorporating a device for locking retracted drawer slide 34 in accordance with a preferred embodiment of the invention. The assembly 30 comprises an outer slide member 31, an inner slide member 32, and a ball bearing retainer 33 provided between the outer slide member 31 and the inner slide member 32. The ball bearing retainer 33 comprises two rows of ball bearings 331 in which each row rolls against opposite grooves along either one of two lengthwise edge portions of the outer slide member 31 and the inner slide member 32. The provision of ball bearings 331 can reduce friction when the inner slide member 32 slides with respect to the outer slide member 31, i.e., facilitating retracting or extending operation of the drawer. The outer slide member 31 comprises a plurality of apertures (one is shown) 312 on its lengthwise channel 311 for permitting a plurality of fasteners (e.g., screws) to drive therethrough for fastening the outer slide member 31 at the wall of a cabinet 40. On a lengthwise channel 321 of the inner slide member 32 there are provided an outwardly projected lock pin 323 and two lanced out tabs 322 threadedly secured to the wall of a drawer 50. The configuration permits the drawer 50 to either extend out of the cabinet 40 by pulling the inner slide member 32 with respect to the outer slide member 31 or retract into the cabinet 40 by pushing the inner slide member 32 with respect to the outer slide member 31. This is known in the art. The subject of the invention is the device for locking retracted drawer slide 34 mounted in a rear portion of the outer slide member 31 as detailed below.

Figure 7:
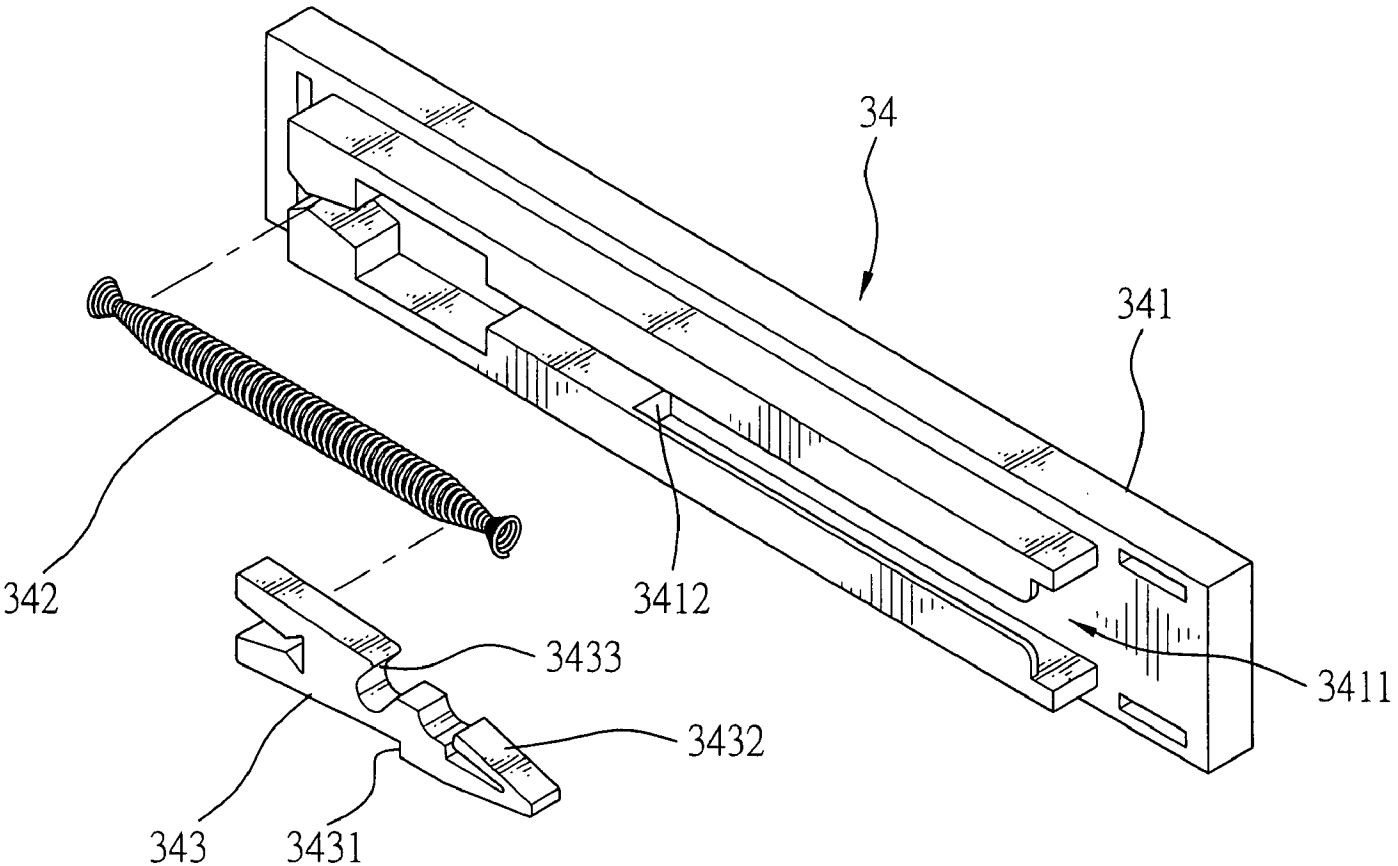
FIG. 7 is an exploded view of the device for locking retracted drawer slide of FIG. 6.
Figure 8:
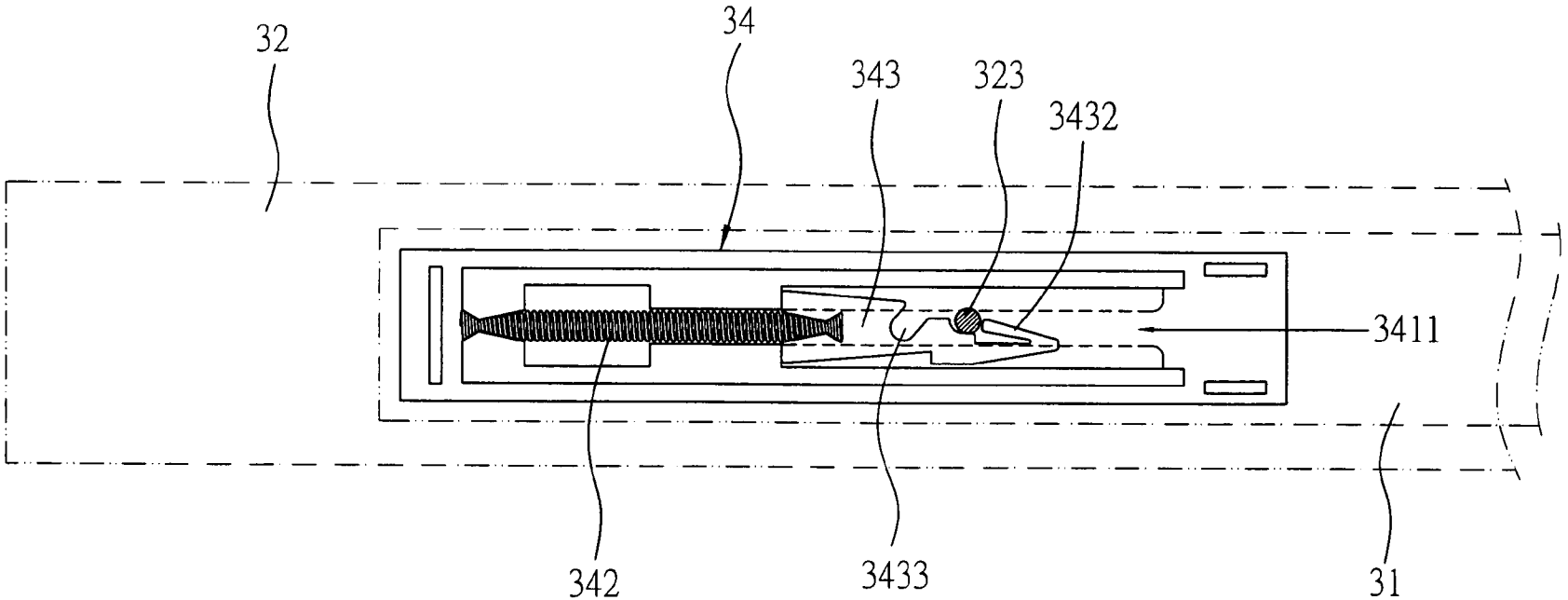
FIG. 8 is a schematic side view of the assembled device for locking retracted drawer slide.

Referring to FIGS. 7 and 8, the device for locking retracted drawer slide 34 comprises an elongate, rectangular member 341, a groove 3411 provided on an inner surface of the member 341, a spring 342 having one end affixed to a rear end of the groove 3411, and an elongate sliding member 343 having its rear end secured to the other end of the spring 342, the sliding member 343 including an intermediate bottom stop surface 3431, an intermediate top notch 3433, and a front hook 3432. As shown in FIG. 8, in an assembled state of the device for locking retracted drawer slide 34, the rear end of the sliding member 343 urges against a shoulder 3412 of an intermediate narrow neck portion of the groove 3411 due to the compression of the spring 342. The lock pin 323 is retained in a recessed portion behind the end of the hook 3432. At this position, the inner slide member 32 and thus the drawer are in a retracted position.

Figure 9:
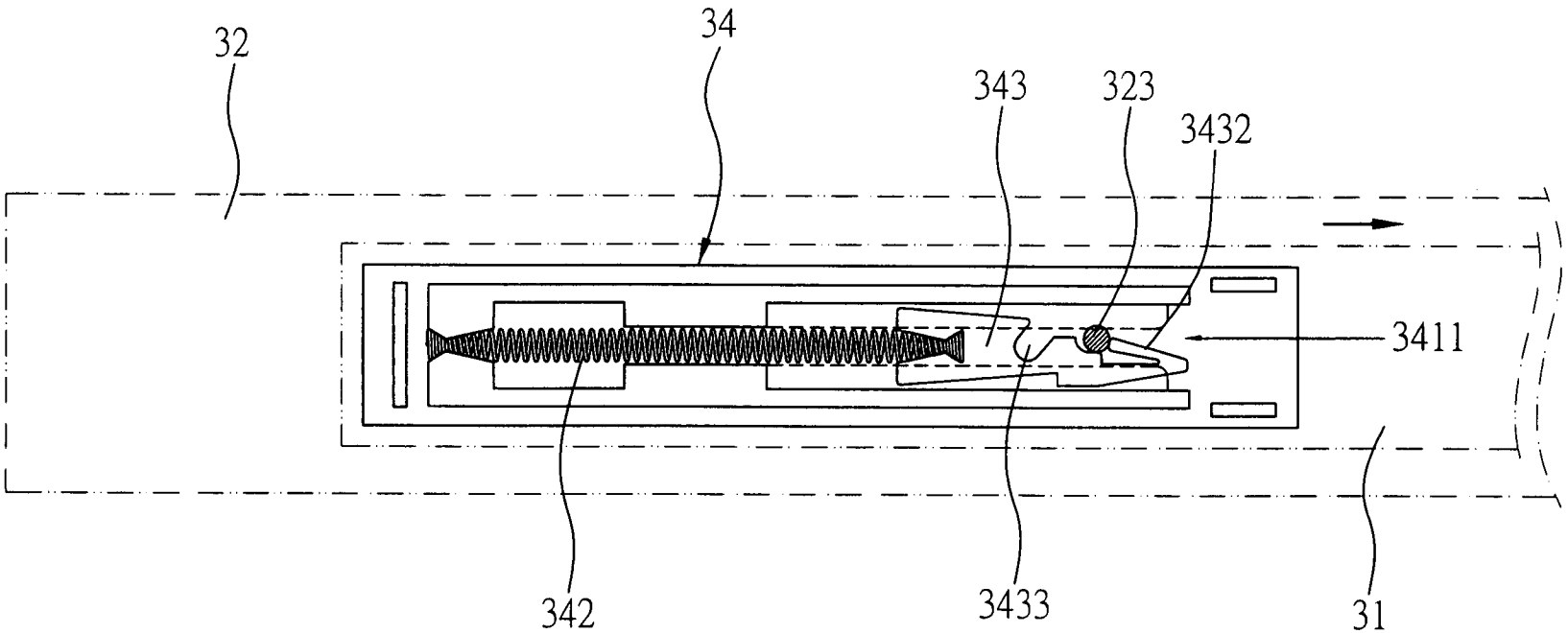
FIGS. 9 and 10 are views similar to FIG. 8 for illustrating two stages of an initial operation of the device for locking retracted drawer slide when the assembly is extending.

Referring to FIG. 9, in an initial extending operation of the drawer (i.e., the inner slide member 32) the pulling of the inner slide member 32 and thus the lock pin 323 will pull the hook 3432 (i.e., the sliding member 343) forward. The forward sliding of the sliding member 343 along the groove 3411 will expand the spring 342.

Figure 10:
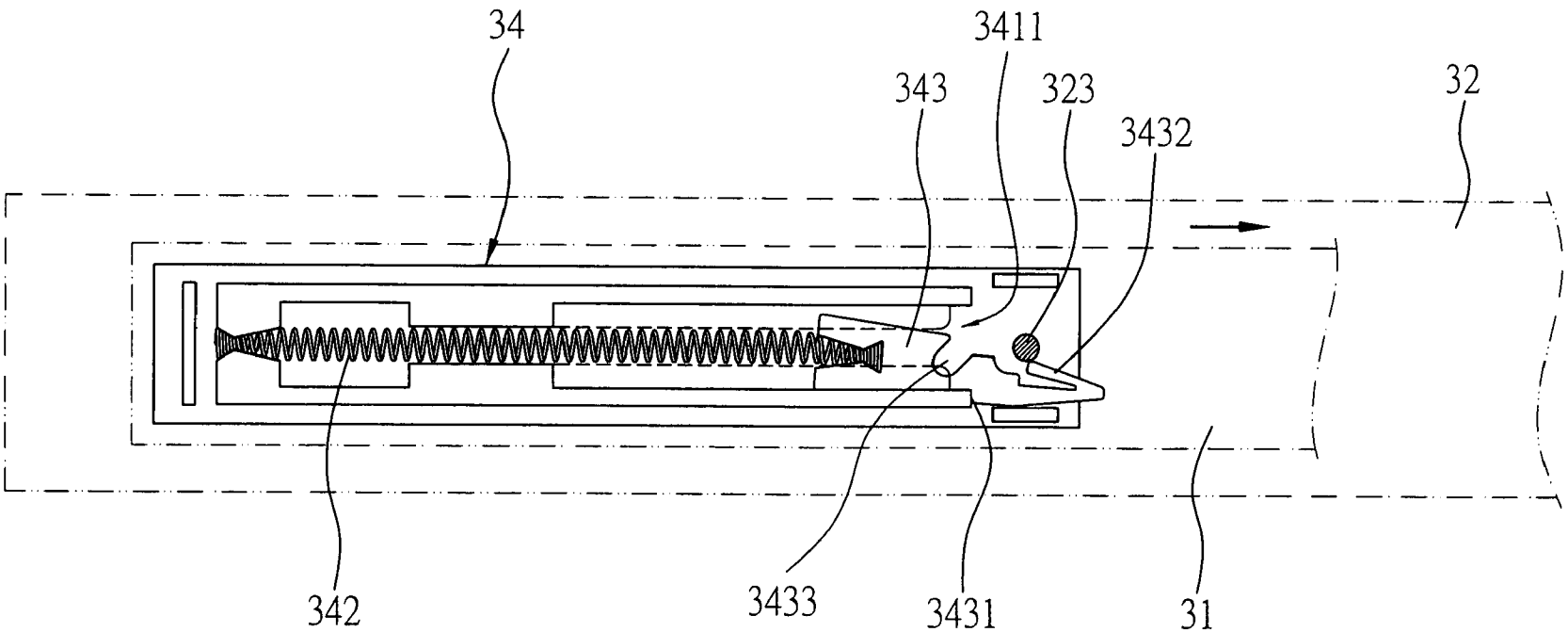

Referring to FIG. 10, as a continuation of the movement shown in FIG. 9, the forward portion of the sliding member 343 will drop due to no support thereunder after passing the front end of the groove 3411. The lock pin 323 clears the notch 3433 after the stop surface 3431 abuts the mouth of the front end of the groove 3411. As a result, the inner slide member 32 continues its forward movement until the drawer is withdrawn (i.e., open).

Figure 11:
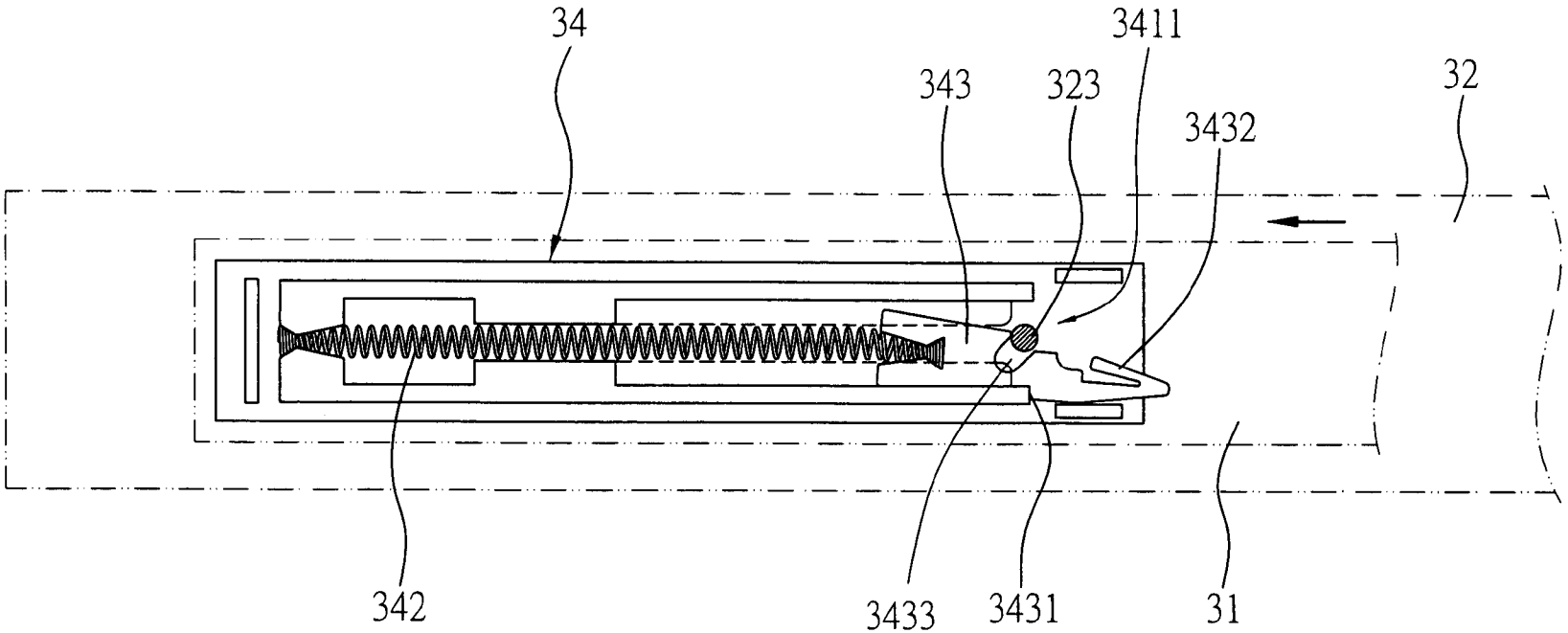
FIGS. 11, 12, and 13 are views similar to FIG. 8 for illustrating three stages of an initial operation of the device for locking retracted drawer slide when the assembly is retracting.

Referring to FIG. 11, in a retracting operation of the drawer (i.e., the inner slide member 32) the pushing of the inner slide member 32 and thus the lock pin 323 continues until the lock pin 323 contacts the notch 3433. The lock pin 323 is then retained therein.

Figure 12:
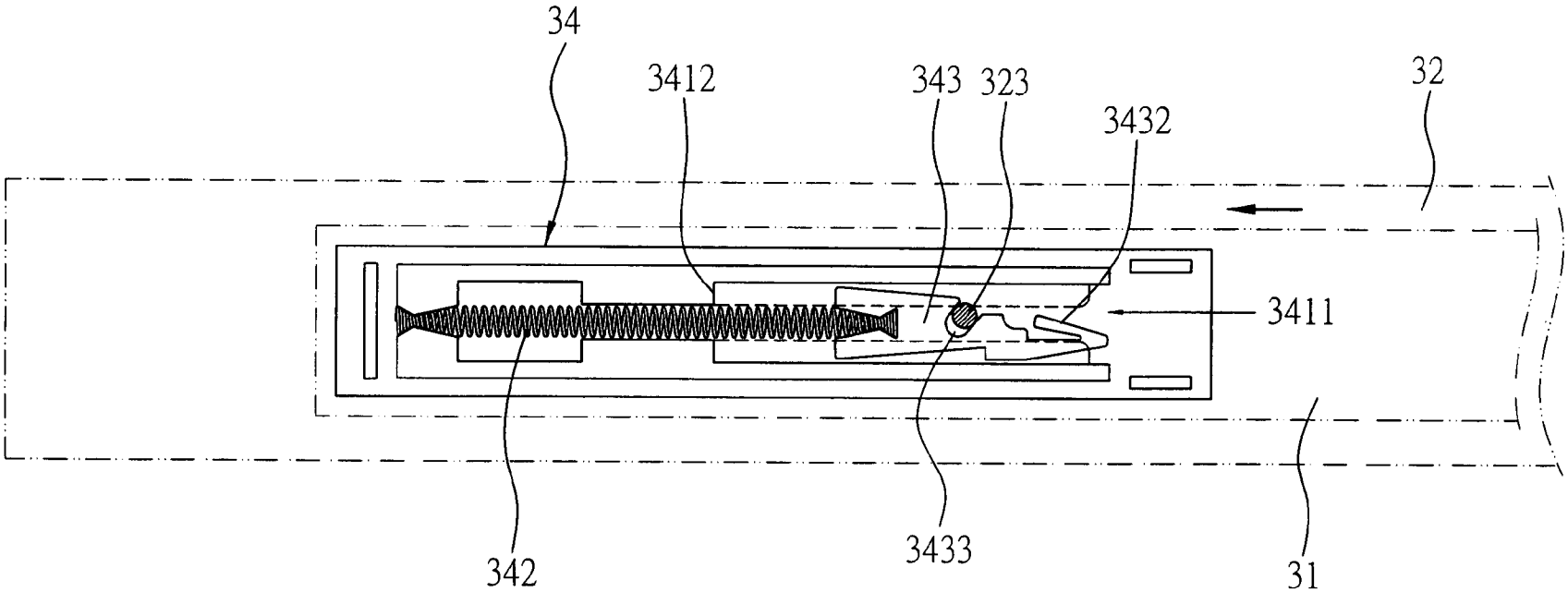

Referring to FIG. 12, as a continuation of the movement shown in FIG. 11, the stop surface 3431 moves upwardly to disengage from the mouth of the front end of the groove 3411 due to an upward pivot of the sliding member 343 with respect to the lock pin 323. The retracting operation of the inner slide member 32 then continues with the sliding member 343 sliding rearward along the groove 3411 due to the compression of the spring 342.

Figure 13:
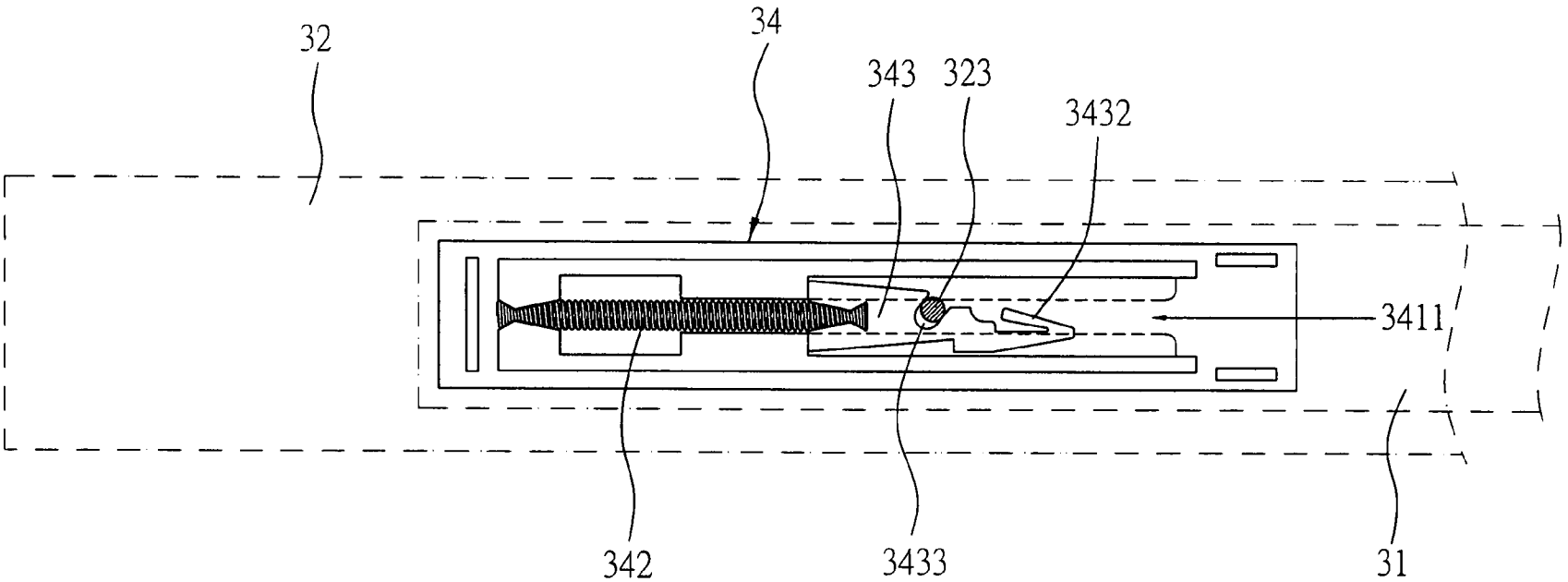

Referring to FIG. 13 in conjunction with FIG. 7 as a continuation of the movement shown in FIG. 12, the retracting operation ends after the rear end of the sliding member 343 is stopped by the shoulder 3412. Components shown in FIG. 13 are in positions the same as that shown in FIG. 8 except that the lock pin 323 is retained in the notch 3433 rather than in the recessed portion behind the hook 3432. That is, the lock pin 323 is always retained (i.e., locked) in the notch 3433 in a retracted state of the drawer slide after the initial extending operation.

Figure 14:
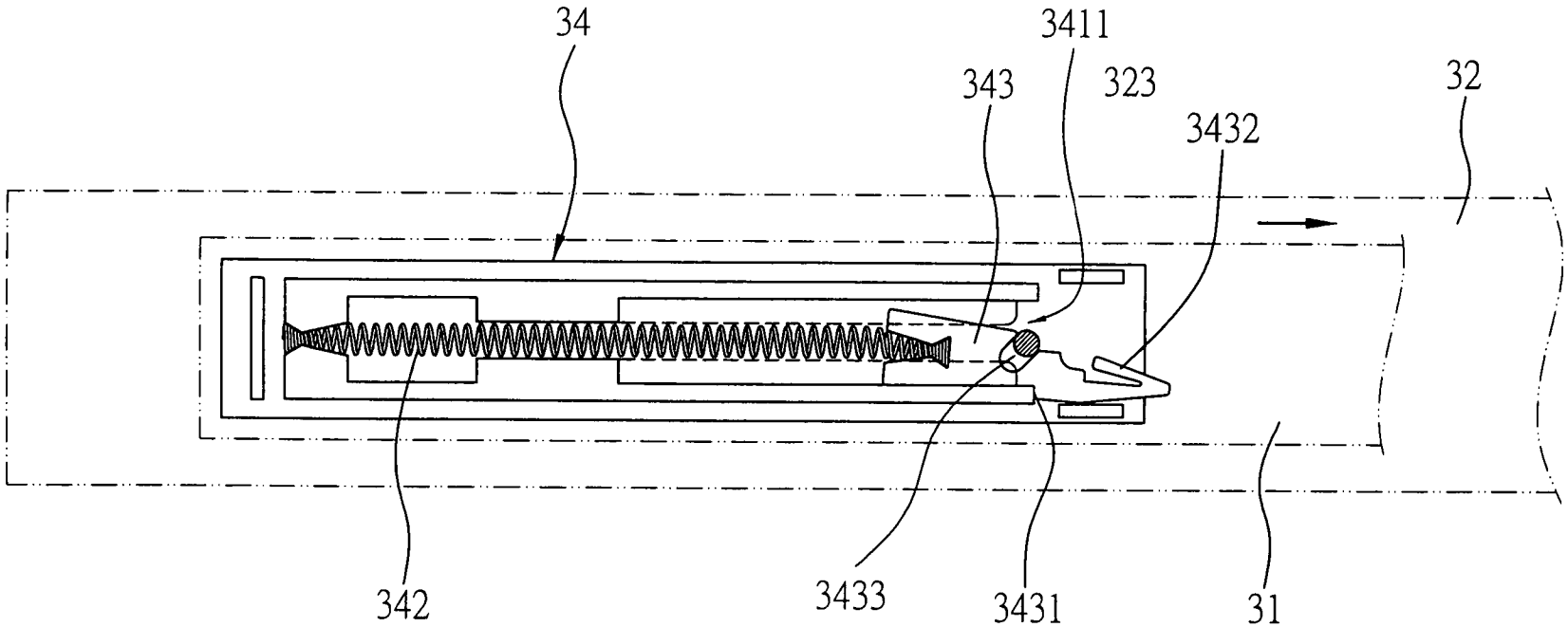
FIG. 14 is a view similar to FIG. 8 for illustrating a subsequent operation of the device for locking retracted drawer slide other than the initial operation thereof when the assembly is extending.

Referring to FIG. 14, in a subsequent extending operation of the drawer (i.e., the inner slide member 32) the pulling of the inner slide member 32 and thus the lock pin 323 will pull the notch 3433 (i.e., the sliding member 343) forward. The forward sliding of the sliding member 343 along the groove 3411 will expand the spring 342. Subsequent stages of the extending operation are the same illustrated in FIGS. 11 and 12. Thus, a detailed description thereof is omitted herein for the sake of brevity.

While the invention herein disclosed has been described by means of specific embodiments, numerous modifications and variations could be made thereto by those skilled in the art without departing from the scope and spirit of the invention set forth in the claims.

What is claimed is:

1. A telescoping slide assembly for supporting a movable drawer in a cabinet, the slide assembly comprising:

an inner slide member affixed to a wall of the drawer, the inner slide member comprising a lengthwise channel including an outwardly projected lock pin;

an outer slide member affixed to a wall of the cabinet, the outer slide member being smaller in cross-sectional area than the inner slide member such that the outer slide member can be received inside the inner slide member to allow a telescopic motion there between;

a ball bearing retainer disposed between the outer and inner slide members for facilitating sliding of the inner slide member with respect to the outer slide member; and locking means disposed in a rear portion of the outer slide member and adopted to be received inside the inner slide member, the locking means comprising an elongate plate, a groove disposed on an inner surface of the plate, the groove including a shoulder at an intermediate narrow neck portion, a resilient member having one end affixed to a rear end of the groove, and an elongate sliding member having a rear end secured to the other end of the resilient member, the sliding member being slidable inside the groove and including a bottom stop surface, a top notch, and a front hook;

wherein the sliding member and the front hook are constructed such that the rear end of the sliding member urges against the shoulder due to a compression of the resilient member, and the lock pin is retained by the front hook when the inner slide member is in a retracted position, the sliding member having a slanted rear portion which ends at the bottom stop surface, the sliding member further having a slanted front portion which pivots downward when the bottom stop surface of the sliding member is being pulled out of a mouth of the groove, causing the lock pin to be freed from the front hook and the bottom stop surface to abut the mouth of the groove, the top notch is disposed behind the front hook and is constructed to receive the lock pin and cause the slanted front portion to pivot upward and be received inside the groove when the inner slide member is being retracted, the top notch is further constructed such that it can retain the lock pin and cause the sliding member to be in motion with the lock pin when the inner sliding member is being pulled until the slanted front portion pivots downward thus releasing the lock pin from the top notch.

2. The slide assembly of claim 1, wherein the resilient member is a spring.

3. The slide assembly of claim 1, wherein the slide member further comprises a recessed portion behind the front hook for positioning the lock pin therein.

4. The slide assembly of claim 1, wherein the front hook has an open end in its rear.

* * * * *